US005842415A

United States Patent [19]

Maass et al.

[11] Patent Number: 5,842,415

[45] Date of Patent: Dec. 1, 1998

[54] PULL LAY ADJUSTING DEVICE

[75] Inventors: Burkhard Maass, Heidelberg; Willi Becker, Bammental; Stefan Dopke, Eppelheim; Michaela Schwab, Leimen, all of Germany

[73] Assignee: Heidelberger Druckmaschinen Aktiengesellschaft, Heidelberg, Germany

[21] Appl. No.: 543,388

[22] Filed: Oct. 16, 1995

[30] Foreign Application Priority Data

Oct. 15, 1994 [DE] Germany ..... 44 37 008.3
Jul. 11, 1995 [DE] Germany ..... 195 25 185.7

[51] Int. Cl.[6] ..... B41F 13/24

[52] U.S. Cl. ..... 101/232; 101/DIG. 36; 271/248; 271/253

[58] Field of Search ..... 101/230, 232, 101/DIG. 36; 400/642; 271/248, 250, 253, 234, 241, 238, 240, 236

[56] References Cited

U.S. PATENT DOCUMENTS

| | | | |
|---|---|---|---|
| 2,730,362 | 1/1956 | Koch | 271/59 |
| 4,750,660 | 6/1988 | Kamimura | 271/240 |
| 5,290,027 | 3/1994 | Clanton et al. | 271/253 |
| 5,358,236 | 10/1994 | Maass et al. | 271/248 |
| 5,454,558 | 10/1995 | Thoma | 271/248 |
| 5,483,888 | 1/1996 | Grieve | 101/232 |
| 5,624,111 | 4/1997 | Maass | 271/236 |

FOREIGN PATENT DOCUMENTS

| | | |
|---|---|---|
| 461 991 | 6/1928 | Germany . |
| 837703 | 5/1952 | Germany . |
| 30 44 826 | 7/1982 | Germany . |
| 43 10 299 | 4/1994 | Germany . |
| 42 11 922 C2 | 8/1994 | Germany . |
| 2 265 887 | 10/1993 | United Kingdom . |

*Primary Examiner*—Christopher A. Bennett
*Attorney, Agent, or Firm*—Herbert L. Lerner; Laurence A. Greenberg

[57] ABSTRACT

Pull lays on a feed table of a sheet-fed rotary printing machine are adjusted by a pulling device for laterally aligning sheets thereon. A spindle, which extends transversely to the travel direction, displaces the pull lays for adjusting to a sheet format to be processed. The spindle engages indirectly at a housing of the side lays which is provided with bearing and guide elements. The pull lays are thereby subject to an energy storing device which supports them in a guide transversely to the feed table.

18 Claims, 3 Drawing Sheets

PULL LAY ADJUSTING DEVICE

BACKGROUND OF THE INVENTION

1. Field of the Invention

The invention relates to pull lays in sheet-fed rotary printing machines, and particularly the disposition and the bearing of a pull lay adjusting device.

It is well-known to dispose pull lay adjusting devices on feed tables of sheet-fed rotary printing presses; the pull lay adjusting devices align the sheets of paper to be processed transversely to the sheet transport direction against side stops. The pull lay adjusting devices generally carry these side stops, and so it is necessary for the pull lay adjusting devices along with the side stops to be adjusted to the sheet format, that is, paper size, to be processed.

2. Description of the Related Art

German Patent Disclosure DE 30 44 826 A1 shows a pull lay adjusting device that is displaceably disposed on a base plate. The displacement force is introduced with a spindle that is rigidly joined to the pull lay adjusting device. A rotary driven nut is operatively connected to a thread of the spindle, so that the pull lay adjusting device together with the spindle is displaceable transversely to the sheet transport direction.

It is a disadvantage in the device of DE 30 44 826 A1 that problems in the adjustment accuracy arise because of production-dictated tolerances in the spindle, the spindle bearing, the pull lay adjusting device, and the bearing of the pull lay adjusting device on the base plate.

Moreover, additional fixation means must be provided in order to lock the pull lay adjusting device in the desired adjusted position.

SUMMARY OF THE INVENTION

It is accordingly an object of the invention to provide a pull lay adjusting device, which overcomes the hereinafore-mentioned disadvantages of the heretofore-known devices of this general type and which allows greater precision in the adjustment of the pull lays in an adjustable-format pull lay system.

With the foregoing and other objects in view there is provided, in accordance with the invention, a pull lay adjusting assembly for laterally aligning sheets on a feed table of a sheet-fed rotary printing press, comprising:

- pull lays movably disposed relative to a feed table of a printing press transversely to a travel direction of the sheets through the printing press;
- a spindle extending transversely to the travel direction for displacing the pull lays and for adjusting to a sheet format of the sheets;
- a housing of the side lays, the spindle extending through the housing; and
- slaving means operatively associated with the spindle, the slaving means engaging the housing of the pull lays.

In accordance with an added feature of the invention, the spindle is supported in the housing of the pull lays in a noncontacting fashion.

The device according to the invention facilitates accurate positioning of the pull lay. Decoupling of such functions as transport of the pull lay, for instance having a spindle, and guidance of the pull lay, for instance by means of crossbars, prevents production-dictated tolerances of the spindle or its bearing from having a negative impact on the guidance or the support of the pull lay.

In accordance with another feature of the invention, there is a projection defined on the housing, and an energy storing device braced between the slaving means and the projection. The energy storing device acting in an adjusting direction transversely to the travel direction.

In accordance with a further feature of the invention, the assembly further comprises bearings rotatably and shiftably supporting the spindle. One of the bearings thereby has an energy storing means acting in an axial direction upon the spindle. The spindle is preferably formed of two coaxial spindles, one for each pull lay.

It is possible for bearing play that occurs to be prevented with the spring elements of the invention. The structural separation of the transport means from the guide elements permits easy installation and removal of the pull lay, since the pull lay adjusting device can be installed and removed without removing the transport means, such as the spindle.

A statically determined bearing of the pull lay by "three-point contact" promotes the stability of the pull lay, especially in the stationary state.

Roller bearing guides avoid so-called stick-slip phenomena, which occur in the case of sliding guides and can lead to jamming or tilting of the pull lays in the positioning process.

A further advantage of the invention is the fact that it is essentially unnecessary to lock the pull lay in the desired position by using additional clamping means, since play between the guide elements and bearings is removed by means of spring elements.

In accordance with an additional feature of the invention, there are provided gear wheels driving the spindle, the gear wheels having a diameter being large relative to a tooth height thereof. To keep the influence of production-dictated tolerances of the drive, especially the gear wheels, to a minimum, gear wheels in which the ratio of the gear wheel diameter to the gear wheel height is quite large are provided.

With the foregoing and other objects in view there is also provided a pull lay adjusting assembly of the above-noted kind which comprises pull lays with a housing supported on the feed table of the paper processing machine and movable transversely to a travel direction of the sheets through the sheet-fed rotary printing machine for selectively adjusting the assembly to a sheet format to be processed; an energy storing device, such as a leaf spring, disposed on the housing, the housing having bearing and guide elements, the guide elements being movably supported in guides formed in the feed table under a force influence of the energy storing device.

The bearing and guide elements are preferably rollers rotatably supported on the housing, and one of the bearing and guide elements is a support arm.

With the energy storing device being a leaf spring, there is also provided a roller rotatably supported on the leaf spring. The roller thereby rests on a support face defined on the feed table structure.

In accordance with a further feature of the invention, the feed table includes two crossbars disposed transversely to the travel direction and having grooves formed therein, and the guides being defined in the grooves.

With the objects of the invention in view there is also provided a pull lay adjusting assembly of the noted kind, with a drive member supported in the feed table for transversely moving the pull lays; a drive shaft for introducing a pulling force on the pull lays, the drive shaft including slaving means for transmitting torques to the drive member.

In accordance with yet an added feature of the invention, the drive shaft has grooves formed therein, and the slaving means are supported radially displaceably with circumferential play in the grooves of the drive shaft. The slaving means are preferably sliding blocks.

In accordance with yet another feature of the invention, a drive member coaxially encompasses the drive shaft in a spaced-apart manner, and the sliding blocks are secured to the drive member. The drive member is preferably a clamp ring.

In other words, a coupling for force transmission of a torque from a drive shaft to the pull lay be embodied in the form of sliding blocks, in such a way that virtually only torques are transmitted. As a result, the forces in the radial direction that arise from production-dictated tolerances are eliminated virtually in their entirety.

In accordance with a concomitant feature of the invention there is also provided a pull lay adjusting assembly of the above-noted kind which includes a feed table for supporting sheets to be processed, the feed table having side walls and crossbars disposed transversely to a travel direction of the sheets through the printing machine; the crossbars, in the region of the pull lay adjusting device, together with the side walls forming a one-piece housing.

It is a particularly favorable feature when the guide elements for the pull lay adjusting device are produced in one piece; that is, the crossbars and guides for receiving the table plates are made in one piece.

Other features which are considered as characteristic for the invention are set forth in the appended claims.

Although the invention is illustrated and described herein as embodied in a pull lay adjusting device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
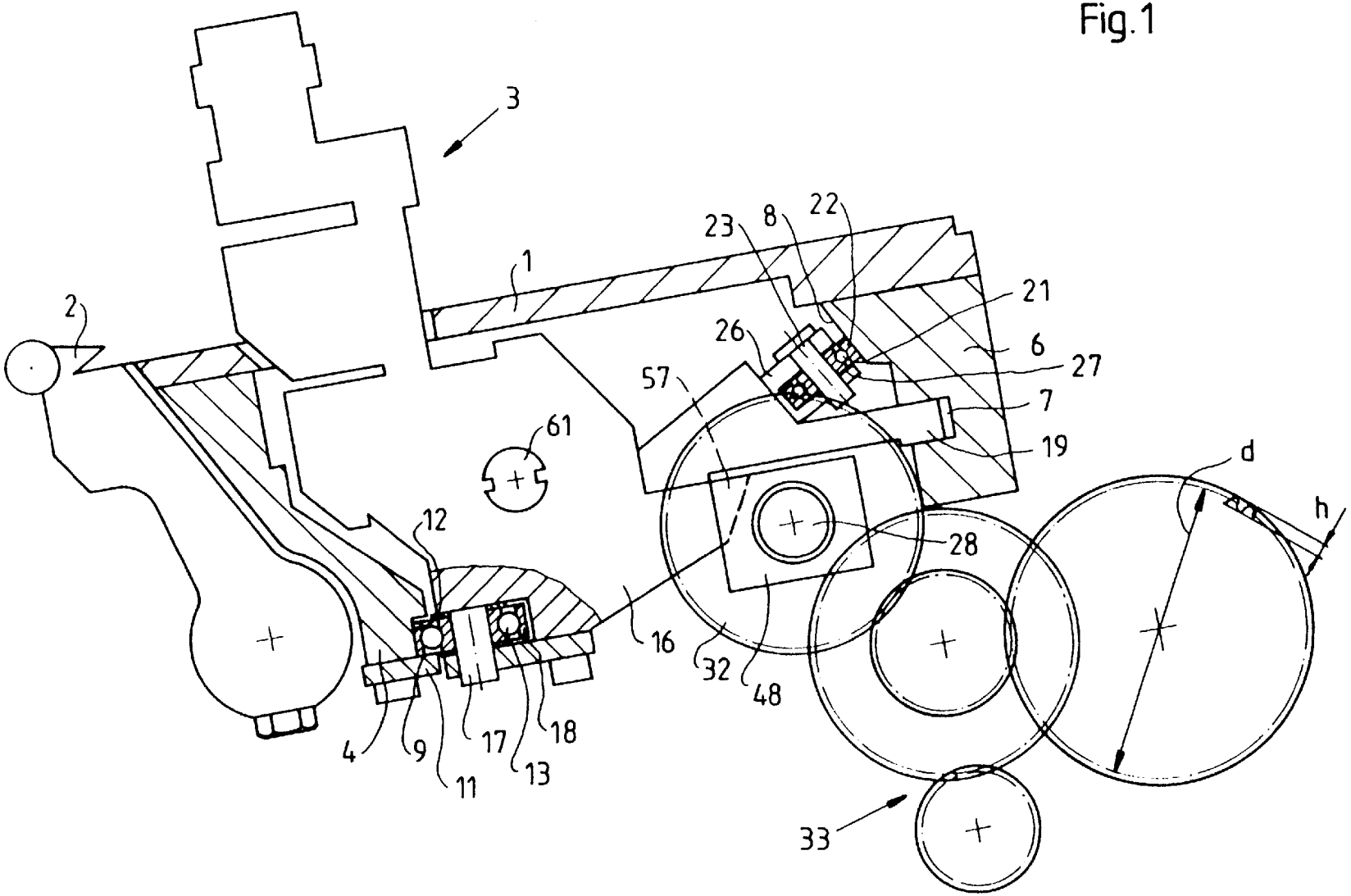
FIG. 1 is a side-elevational view of a pull lay adjusting device.
Figure 2:
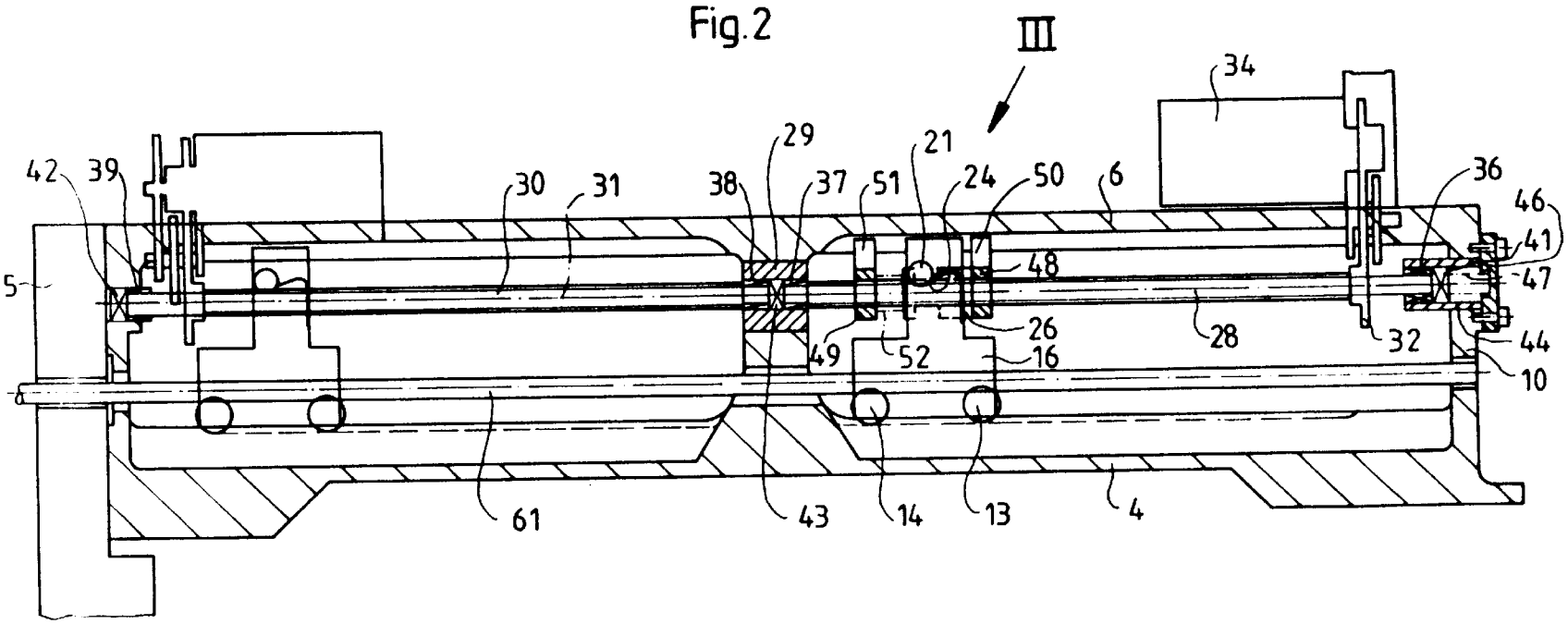
FIG. 2 is a plan view on the pull lays and the adjusting device.
Figure 3:
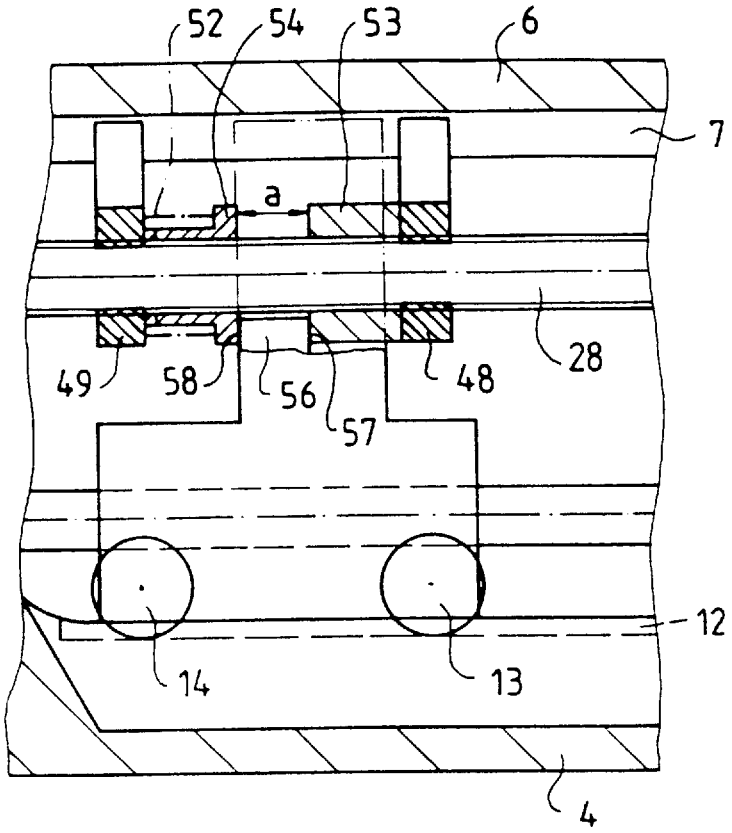
FIG. 3 is an enlarged view of a portion III of FIG. 2.

Referring now to the figures of the drawing in detail and first, particularly, to FIGS. 1 and 2 thereof, there is seen a feed table 1 for a sheet-fed printing press. One pull lay adjusting device 3, movable transversely to the sheet transport direction, is provided on each of the two sides in the region of pregrippers or front lays 2. Mutually parallel crossbars 4 and 6 are disposed below the feed table 1. The two crossbars 4 and 6 extend from one side to the other crosswise below the feed table 1, as seen in the travel direction of the sheets through the paper processing machine. At least in the region of the pull lay adjusting device 3, the crossbars 4, 5 are made in one piece, and together with the side walls 5 and 10, they form a housing 15 or a frame 15. The rear crossbar 6 has a guide groove 7 and an oblique support face 8. The front crossbar 4 has a shoulder 9, which together with a rail 11 defines a guide groove 12.

The pull lay 3 has two substantially horizontal disposed rollers 13 and 14, i.e. they are rotatable about substantially vertical axes. The rollers are rotatably supported on a lower end of a housing 16 of the pull lay 3 by means of one bolt 17 each. A bearing race 18 of the roller 13 and 14 engages the guide groove 12.

A horizontal support arm 19 is permanently joined to the housing 16 at a rear end thereof. One end of the support arm 19 is guided in the groove 7 in order to carry the torque thereof, i.e. it acts as a torque lever. The horizontal rollers 13, 14 and the horizontal support arm 19 are bearing and guiding elements of the housing 16.

The housing 16 has a further rotatably supported roller 21 above the support arm 19. A bearing race 22 of the roller 21 is in rolling contact with the oblique support face 8. The roller 21 is supported on a bolt 23 in a bend 24 of a leaf spring 26; the bearing race 22 extends through an opening 27 in the leaf spring 26. The spring force is calculated such that bearing play of the rollers 13, 14, 21 in the guide groove 7 and on the support arm 19 in the guide groove 12 is essentially compensated.

Spindles 28 and 30 are provided for adjusting the format spacing between the pull lays 3, one spindle for each of the two pull lays. The spindles are rotatably supported at their shaft ends in the side walls 5 and 10, respectively, and approximately in the middle in a common bearing 29. The spindles are further supported so as to be axially displaceable along small distances. The spindles 28 and 30 are disposed along a common axis 31 and each have a gear wheel 32, permanently joined to it. The gear wheels 32 are rotatingly driven by a respective drive motor 34 via a respective gear wheel transmission 33.

Tooth play is reduced in that the gear wheel 32 has a large diameter d in proportion to its tooth height h. The term "large" is thereby defined as being in the neighborhood of approximately one order of magnitude.

Each of the spindles 28, 30 are rotatably supported in respective radial needle bearings 36–39 and on their face ends each have one axial needle bearing 41, 42 and one common axial needle bearing 43. The axial needle bearing 42 is axially displaceable in a bearing bush 44 in the side wall 10. The axial needle bearing 43 is supported axially displaceably and rotatably in the bearing 29. An energy storing means such as a compression spring 47, disposed coaxially with the axis 31 between the axial needle bearing 42 and a bottom 46 of the bearing bush 44 expels a production-dictated axial play of the spindles 28, 30 that arises at the bearing.

Two spaced-apart slaving means such as nuts 48 and 49 are axially movably supported on each spindle 28 and 30. Each nut 48 and 49 has a support arm 50 and 51, respectively, which displaceably engages the guide groove 7. The arm, therefore, and its engagement in the guide groove 7 prevents rotation of the nut 48, 49.

A spacer sleeve 53 and a bush 54 acted upon by the force of a compression spring 52 are axially displaceably supported between the nuts 48 and 49. A projection or a cam 56 of the housing 16 engages at a distance a between the bush 54 and the spacer sleeve 53 and is clamped there, under the force of the compression spring 52. The clamping and guidance of the pull lay 3 by means of the spacer sleeve 51 and the bush 54 is effected via a respective contact face 57 and 58 of the projection 56. No contact between the spindle 28 or 30 and the housing 16 of the pull lay 3 takes place.

Figure 4:
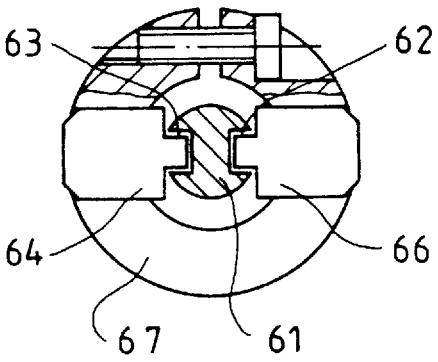
FIG. 4 is a radial section of the drive shaft of the adjusting device.

Referring now particularly to FIG. 4, a drive shaft 61 is drivably and rotatably supported in the side walls 5, 10. In a region in which the torque transmission to the pull lay 3 takes place, the drive shaft 61 has two diametrically opposed feather key grooves 62 and 63. Each of the feather key grooves 62 and 63 is engaged by a respective slaving means such as sliding block 64 and 66. The sliding block thereby has axial and radial play; the sliding blocks are permanently screwed to a clamping ring 67 that coaxially encompasses the drive shaft 61 in spaced-apart fashion.

The clamping ring 67 is permanently connected to a drive means for a pulling roller in the pull lay 3. The sliding blocks 64 and 66 are each supported with play on the bottom and on the side walls of the feather key groove 62 and 63, so that production-dictated tolerances—concentricity factors of the drive shaft 61, for instance, and its bearing or drive means—have no influence on the pull lay, and aside from torques virtually no other forces are transmitted to the pull lay 3.

We claim:

1. A pull lay adjusting assembly for laterally aligning sheets on a feed table of a sheet-fed rotary printing press, comprising:

pull lays movably disposed relative to a feed table of a printing press transversely to a travel direction of the sheets through the printing press;

a spindle extending transversely to the travel direction for displacing said pull lays and for adjusting to a sheet format of the sheets;

a housing of said side lays, said spindle extending parallel to said housing; and slaving means operatively associated with said spindle, said slaving means engaging said housing of said pull lays.

2. The assembly according to claim 1, wherein said spindle is supported in said housing of said pull lays in a noncontacting fashion.

3. The assembly according to claim 1, which further comprises a projection defined on said housing, and an energy storing device braced between said slaving means and said projection, said energy storing device acting in an adjusting direction transversely to the travel direction.

4. The assembly according to claim 1, which further comprises bearings rotatably and shiftably supporting said spindle.

5. The assembly according to claim 4, wherein at least one of said bearings has an energy storing means acting in an axial direction upon said spindles.

6. The assembly according to claim 1, which further comprises gear wheels driving said spindle, said gear wheels having a diameter being large relative to a tooth height thereof.

7. A pull lay adjusting assembly for laterally aligning paper sheets on a feed table of a sheet-fed rotary printing machine, comprising:

a feed table;

pull lays with a housing supported on said feed table and being movable transversely to a travel direction of the sheets through the sheet-fed rotary printing machine for selectively adjusting the assembly to a sheet format to be processed;

an energy storing device disposed on said housing, said housing having bearing and guide elements, said guide elements being movably supported in guides formed in said feed table under a force influence of said energy storing device.

8. The assembly according to claim 7, wherein said bearing and guide elements are rollers rotatably supported on said housing.

9. The assembly according to claim 7, wherein one of said bearing and guide elements is a support arm.

10. The assembly according to claim 7, wherein said energy storing means is a leaf spring.

11. The assembly according to claim 10, which further comprises a support face defined on said feed table, and a roller rotatably supported on said leaf spring, said roller resting on said support face defined on said feed table.

12. The assembly according to claim 7, wherein said feed table includes two crossbars disposed transversely to the travel direction and having grooves formed therein, and said guides being defined in said grooves.

13. A pull lay adjusting assembly for laterally aligning sheets on a feed table of a sheet-fed rotary printing machine, comprising:

a feed table;

pull lays supported on said feed table and being movable transversely to a travel direction of the sheets through the sheet-fed rotary printing machine for selectively adjusting the assembly to a sheet format to be processed;

a drive member supported in said feed table for transversely moving said pull lays;

a drive shaft for introducing a pulling force on said pull lays, said drive shaft including slaving means for transmitting torques to said drive member.

14. The assembly according to claim 13, wherein said drive shaft has grooves formed therein, and said slaving means are supported radially displaceably with circumferential play in said grooves of said drive shaft.

15. The device according to claim 13, wherein said slaving means are sliding blocks.

16. The assembly according to claim 15, which further comprises a drive shaft drive member coaxially encompassing said drive shaft in a spaced-apart manner, said sliding blocks being secured to said drive shaft drive member.

17. The assembly according to claim 16, wherein said drive shaft drive member is a clamp ring.

18. A pull lay adjusting assembly for laterally aligning sheets on a feed table of a sheet-fed rotary printing machine, comprising:

a feed table for supporting sheets to be processed, said feed table having side walls and crossbars disposed transversely to a travel direction of the sheets through the printing machine;

pull lays movably disposed on said feed table for adjusting to a sheet format to be processed;

said crossbars, in the region of the pull lay adjusting device, together with said side walls forming a one-piece housing.

* * * * *